US010324401B1

(12) United States Patent
Numakura

(10) Patent No.: US 10,324,401 B1
(45) Date of Patent: Jun. 18, 2019

(54) IMAGE FORMING APPARATUS, IMAGE RECOLORING APPARATUS AND IMAGE FORMING METHOD

(71) Applicants: KABUSHIKI KAISHA TOSHIBA, Tokyo (JP); TOSHIBA TEC KABUSHIKI KAISHA, Tokyo (JP)

(72) Inventor: Yoshikatsu Numakura, Ito Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/925,128

(22) Filed: Mar. 19, 2018

(51) Int. Cl.
*G03G 15/20* (2006.01)
*G03G 15/00* (2006.01)

(52) U.S. Cl.
CPC ..... *G03G 15/2021* (2013.01); *G03G 15/6573* (2013.01); *G03G 15/6585* (2013.01); *G03G 2215/209* (2013.01)

(58) Field of Classification Search
CPC ..... G03G 15/0121; G03G 15/2021; G03G 15/6573; G03G 15/6585; G03G 2215/209; G03G 2215/2074
USPC ..... 399/223
See application file for complete search history.

(56) References Cited

U.S. PATENT DOCUMENTS

| | | | | |
|---|---|---|---|---|
| 5,876,898 | A | 3/1999 | Ikeda et al. | |
| 9,213,286 | B1 * | 12/2015 | Ogasawara | G03G 15/0189 |
| 2010/0196063 | A1 * | 8/2010 | Iguchi | B41J 3/546 399/322 |
| 2012/0141154 | A1 * | 6/2012 | Yoshida | G03G 15/6585 399/69 |
| 2012/0141932 | A1 | 6/2012 | Yamauchi | |
| 2014/0193168 | A1 * | 7/2014 | Kimoto | G03G 15/205 399/69 |
| 2015/0168875 | A1 * | 6/2015 | Udo | G03G 15/16 399/298 |
| 2016/0026108 | A1 * | 1/2016 | Ikuta | G03G 15/0121 399/223 |

FOREIGN PATENT DOCUMENTS

JP 2000225770 A 8/2000

* cited by examiner

*Primary Examiner* — Robert B Beatty
(74) *Attorney, Agent, or Firm* — Kim & Stewart LLP

(57) ABSTRACT

An image forming apparatus includes a first image forming section configured to form an image on a sheet with a decolorable color material decolorable, a second image forming section configured to form an image on the sheet with a non-decolorable color material, a fixing device configured to heat the sheet on which the images are formed with the decolorable color material and the non-decolorable color material, and a cooling section configured to cool the heated sheet.

20 Claims, 4 Drawing Sheets

| PRINTING INSTRUCTION | SET TEMPERATURE(℃) |
|---|---|
| PRINTING BY NON-DECOLORABLE TONER | 130 |
| PRINTING BY DECOLORABLE TONER | 100 |
| PRINTING BY NON-DECOLORABLE TONER AND DECOLORABLE TONER | 130 |

IMAGE FORMING APPARATUS, IMAGE RECOLORING APPARATUS AND IMAGE FORMING METHOD

FIELD

Embodiments described herein relate generally to an image forming apparatus, an image recoloring apparatus and an image forming method.

BACKGROUND

Conventionally, in an image forming apparatus, in a case of performing printing on one sheet using both of a decolorable toner and a non-decolorable toner, it is necessary to perform the printing twice due to the difference in a fixing temperature. As a result, it takes extra time to perform the printing using the decolorable toner and the non-decolorable toner. Such a problem may occur not only when printing using a toner but also when printing using color material which can be decolored by heat and a non-decolorable color material.

DETAILED DESCRIPTION

In accordance with an embodiment, an image forming apparatus comprises a first image forming section configured to form an image on a sheet with a decolorable color material decolorable, a second image forming section configured to form an image on the sheet with a non-decolorable color material, a fixing device configured to heat the sheet on which the images are formed with the decolorable color material and the non-decolorable color material, and a cooling section configured to cool the heated sheet.

Hereinafter, an image forming apparatus, an image recoloring apparatus, and an image forming method of an embodiment are described with reference to the accompanying drawings.

Figure 1:
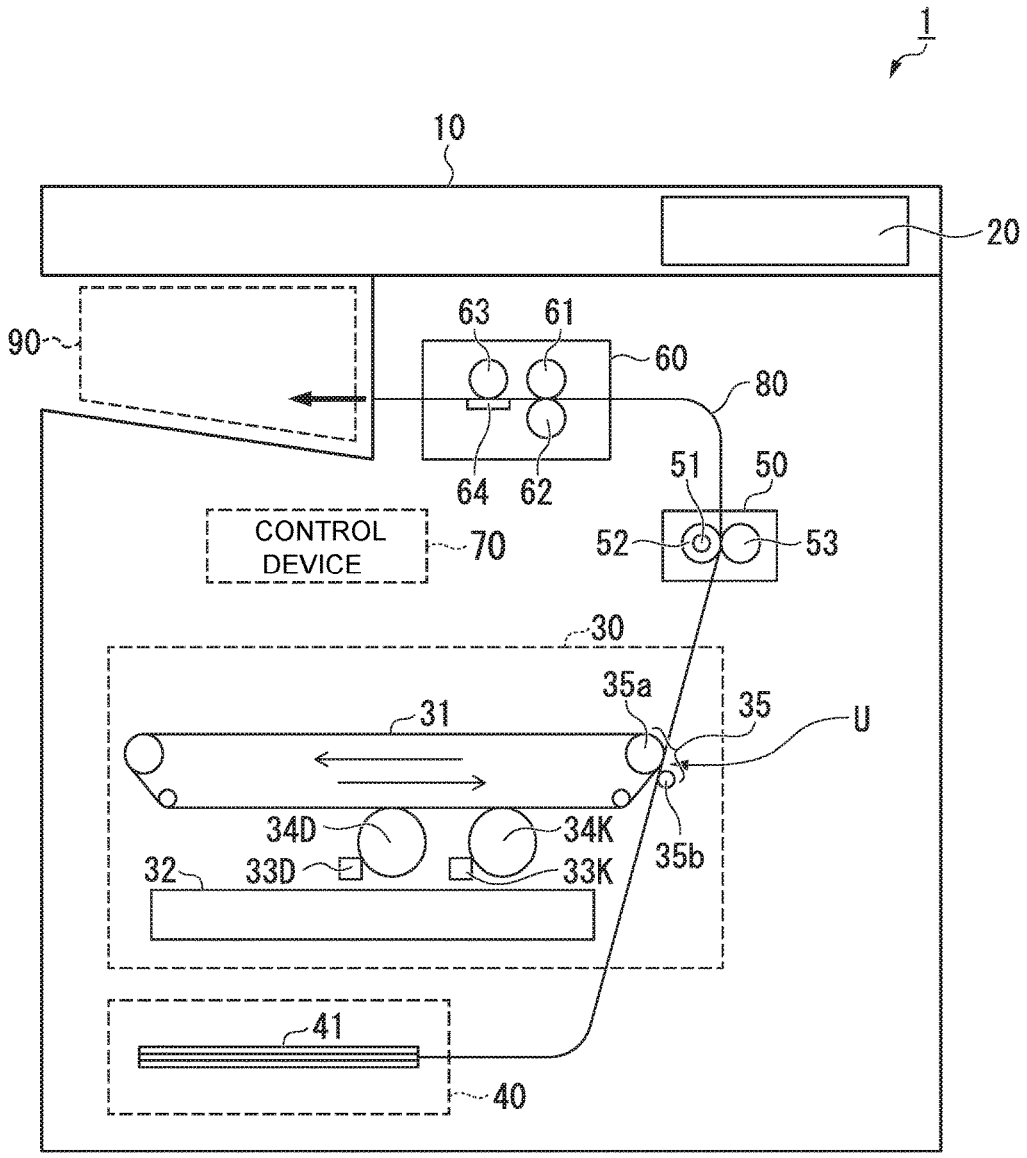
FIG. 1 is a schematic cross-sectional view of an image forming apparatus according to an embodiment.

FIG. 1 is a schematic cross-sectional view of the image forming apparatus of the embodiment.

An image forming apparatus 1 of the embodiment is a multifunction peripheral (MFP). The image forming apparatus 1 performs an image forming process. The image forming process is a process of forming an image on a sheet. The sheet is, for example, a paper sheet. The image forming apparatus 1 reads an image shown on the sheet and generates digital data to generate an image file. The sheet subjected to the image reading can be any type of sheet.

The image forming apparatus 1 includes an image reading section 10, a control panel 20, an image forming section 30, a sheet housing section 40, a fixing device 50, a cooling section 60, a control device 70 and a discharge section 90.

The image reading section 10 reads an image which is a reading object as intensity of light. For example, the image reading section 10 reads an image printed on the sheet which is the reading object placed on a document reading table which is provided at the upper surface of the image reading section 10. The image reading section 10 records the read image data. The recorded image data may be transmitted to another information processing apparatus via a network. The recorded image data may be used to form an image on the sheet by the image forming section 30.

The control panel 20 includes a display section and an operation section. The display section is a display device such as a liquid crystal display and an organic EL (Electro Luminescence) display. The display section displays various information about processing in the image forming apparatus 1 under the control of the control device 70. The operation section includes a plurality of buttons and the like. The operation section receives an operation inputs by a user. The operation section outputs a signal corresponding to the operation inputs by the user on the control device 70. The display section and the operation section may be integrally provided as a touch panel.

The image forming section 30 executes the image forming process. In the image forming process, the image forming section 30 forms an image on the sheet based on the image data generated by the image reading section 10 or image data received via a communication path. The image forming section 30 according to the present embodiment uses a decolorable toner that can be decolored by heating and a non-decolorable toner which is not decolored by heating. "Decoloring" means making an image formed with a color (including not only chromatic color but also achromatic color such as white and black) different from a base color of the sheet so that the color is difficult to visually recognize.

The non-decolorable toner is, for example, a black (K) toner. In a case in which the image forming apparatus 1 is a device capable of performing printing using multiple colors, the non-decolorable toner may be toner of yellow (Y), magenta (M), cyan (C), black (K) or the like. Similar to the non-decolorable toner, the decolorable toner is a colored toner, for example, blue. The decolorable toner is decolored at a temperature higher than a temperature at which the non-decolorable toner is fixed on the sheet. The decolorable toner used in the present embodiment is a toner which is decolored at high temperature and develops a color again if maintained at a temperature lower than a predetermined recoloring temperature after decoloring. As such a decolorable toner, a toner disclosed in a known technology (for example, U.S. Pat. No. 8,252,496) may be used.

The image forming section 30 includes a transfer belt 31, an exposure section 32, a developing device 33D, a developing device 33K, a photoconductive drum 34D, a photoconductive drum 34K, and a transfer section 35.

The transfer belt 31 is an intermediate transfer body. The transfer belt 31 rotates in a direction indicated by an arrow.

The exposure section 32 is provided at a position facing the photoconductive drums 34K and 34D of the developing devices 33K and 33D. The exposure section 32 irradiates outer circumferential surfaces (which are photoconductive layers) of the photoconductive drums 34K and 34D of the developing devices 33K and 33D with laser light. The exposure section 32 is controlled to emit light based on the image data under the control of the control device 70. The exposure section 32 emits the laser light based on the image data. In this way, the negative charge on the outer circumferential surfaces of the photoconductive drums 34K and 34D of the developing devices 33K and 33D is eliminated.

As a result, a static electricity pattern is formed at a position irradiated with the laser light on the surfaces of the photoconductive drums 34K and 34D. Electrostatic latent images are formed on the surfaces of the photoconductive drums 34K and 34D by irradiation of the laser light by the exposure section 32. In the exposure section 32, LED (Light Emitting Diode) light may be used in place of the laser light.

The developing device 33D and the developing device 33K supply toner to the photoconductive drum 34D and the photoconductive drum 34K. For example, the developing device 33D develops the electrostatic latent image on the outer circumferential surface of the photoconductive drum 34D with the decolorable toner. The developing device 33K develops the electrostatic latent image on the surface of the photoconductive drum 34K with black (K) toner. The developing device 33D and the developing device 33K form toner images as visible toner images on the photoconductive drum 34D and the photoconductive drum 34K. The toner images formed on the photoconductive drum 34D and the photoconductive drum 34K are transferred (primary transfer) onto an outer circumferential surface of the transfer belt 31. The developing device 33D and the photoconductive drum 34D are an example of a first image forming section which forms an image on the sheet with the decolorable toner. The developing device 33K and the photoconductive drum 34K are an example of a second image forming section which forms an image on the sheet with the non-decolorable toner.

The transfer section 35 includes a support roller 35*a* and a secondary transfer roller 35*b*. The transfer section 35 transfers the toner image on the transfer belt 31 onto the sheet at a secondary transfer position U. The secondary transfer position U is a position where the support roller 35*a* and the secondary transfer roller 35*b* face each other across the transfer belt 31. The transfer section 35 applies a transfer bias controlled by a transfer current to the transfer belt 31. The transfer section 35 transfers the toner image on the transfer belt 31 onto the sheet by the transfer bias. The control device 70 controls the transfer current used for the secondary transfer processing.

The sheet housing section 40 includes one or more sheet feed cassettes. The sheet feed cassette houses a sheet 41 of a predetermined size and a predetermined type. The sheet feed cassette has a pickup roller (not illustrated). The pickup roller picks up the sheets 41 one by one from the uppermost sheet in the sheet feed cassette. The pickup roller supplies the sheet 41 taken out to a conveyance section 80.

The fixing device 50 fixes the toner image on the sheet 41 by applying heat and pressure to the sheet 41. The fixing device 50 includes a heating source 51, a heat roller 52, and a pressure roller 53. The heating source 51 is a heater having a halogen lamp or an induction heating (IH) system heater or the like. The heating source 51 is turned on or turned off according to presence or absence of energization from the control device 70. The heat roller 52 is warmed by the heat generated at the time the heating source 51 is energized. The heat roller 52 applies the heat to the sheet 41. The pressure roller 53 is arranged to face the heat roller 52 across a sheet conveying path. The pressure roller 53 presses the sheet 41 against the heat roller 52. The fixing device 50 is provided with a temperature sensor (not shown). The temperature sensor measures the temperature of the heat roller 52. The temperature sensor transmits the measured temperature of the heat roller 52 to the control device 70.

The cooling section 60 recovers the color of the image formed with the decolorable toner on the sheet 41 decolored by the fixing device 50 by cooling the sheet 41 heated by the fixing device 50. In other words, the decolored image becomes visible again as a result of "recoloring" the image by cooling the sheet 41. The image decolored by the fixing device 50 becomes visible by cooling at the recoloring temperature lower than the predetermined temperature. The recoloring temperature is a temperature at which the color of the decolored image is recovered, and for example, it is −20 degrees centigrade or less. The cooling section 60 includes a plurality of rollers 61, 62 and 63 and a coolant 64. The rollers 61, 62 and 63 convey the sheet 41. The coolant 64 cools the inside of the cooling section 60. The coolant 64 is, for example, a Peltier element. The coolant 64 lowers the temperature in the cooling section 60 according to the current applied from the control device 70. The cooling section 60 is provided at the downstream side of the fixing device 50 in a conveyance direction of the sheet 41. The cooling section 60 may be provided at any position on a route between the fixing device 50 and the discharge section 90 as long as it is a position where the sheet 41 heated by the fixing device 50 can be cooled. The cooling section 60 cools the sheet 41 heated through the image formation by the decolorable toner and the non-decolorable toner. As described above, the cooling section 60 has a function of recoloring the image.

The control device 70 controls each functional section of the image forming apparatus 1.

The conveyance section 80 conveys the sheet 41. The conveyance section 80 includes a conveyance path and a plurality of rollers (not shown). The conveyance path is a route along which the sheet 41 is conveyed. The rollers convey the sheet 41 by rotating under the control of the control device 70.

The discharge section 90 receives the sheet 41 conveyed by the conveyance section 80 and discharged onto the discharge section 90.

Figures 2, 3:
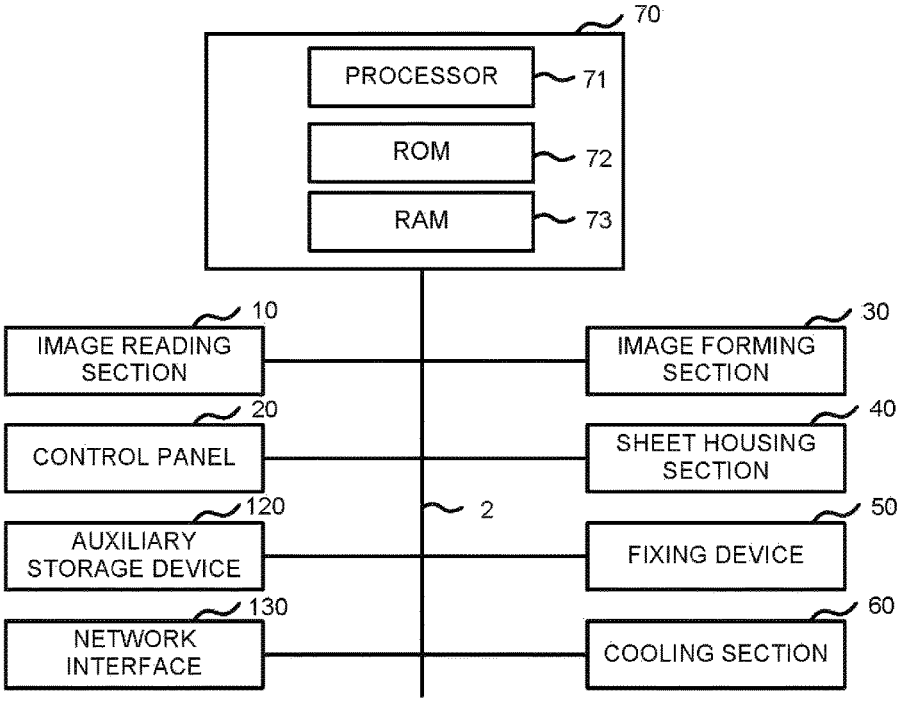
FIG. 2 is a block diagram illustrating an example of hardware components of the image forming apparatus.
FIG. 3 is a diagram illustrating a specific example of a temperature setting table.

FIG. 2 is a block diagram illustrating an example of a hardware components of the image forming apparatus 1.

The image forming apparatus 1 includes the image reading section 10, the control panel 20, the image forming section 30, the sheet housing section 40, the fixing device 50, the cooling section 60, the control device 70, an auxiliary storage device 120, and a network interface 130.

The image reading section 10, the control panel 20, the image forming section 30, the sheet housing section 40, the fixing device 50, and the cooling section 60 are the same as those explained above, and therefore the description thereof is omitted. The control device 70, the auxiliary storage device 120, and the network interface 130 are described below. Each of components is connected in a data communicable manner via a system bus line 2.

The control device 70 includes a processor 71, a ROM (Read Only Memory) 72, and a RAM (Random Access Memory) 73. The processor 71 is, for example, a processor such as a CPU (Central Processing Unit). The processor 71 controls the operation of each functional section of the image forming apparatus 1. The processor 71 executes various processing by copying or developing a program stored in the ROM 72 in the RAM 73 and executing it. The ROM 72 stores the program for operating the processor 71. The RAM 73 temporarily stores data used by each functional section of the image forming apparatus 1. The RAM 73 may temporarily store the digital data generated by the image reading section 10. Further, the RAM 73 may temporarily store jobs to be executed in the image forming apparatus 1 and job logs.

The network interface 130 transmits and receives data to and from other devices. Here, the other device is an information processing apparatus such as a personal computer, for example. The network interface 130 operates as an input interface to receive data or instructions transmitted from other devices. The instruction transmitted from another device is a printing execution instruction or the like. The network interface 130 operates as an output interface to transmit the data to another device.

The auxiliary storage device 120 is, for example, a hard disk or an SSD (solid state drive) and stores various data. The various data include, for example, a temperature setting table, digital data, jobs and job logs. The temperature setting table is used to register information on temperature setting of the fixing device 50.

FIG. 3 is a diagram illustrating a specific example of the temperature setting table. The temperature setting table has a plurality of records indicating information on the temperature setting of the fixing device 50. Each record associates a set temperature with a printing instruction. The printing instruction indicates the printing instruction issued to the image forming apparatus 1. The set temperature indicates the temperature to be set as the target temperature of the heat roller 52 of the fixing device 50. The set temperature indicates a fixing temperature at which the fixing of at least one toner is enabled.

In an example shown in FIG. 3, a plurality of "printing instructions" is registered in the "temperature setting table". In FIG. 3, in a record registered in the uppermost row of the temperature setting table, the printing instruction "printing by non-decolorable toner" is associated with the set temperature of "130 degrees centigrade". This indicates that the temperature of the heat roller 52 of the fixing device 50 is set to 130 degrees centigrade if the instruction of printing by the non-decolorable toner is received by the control panel 20. In the example in FIG. 3, 130 degrees centigrade is shown as the fixing temperature of the non-decolorable toner.

In a record registered in the second row of the temperature setting table, the printing instruction "printing by decolorable toner" is associated with the set temperature of "100 degrees centigrade". This indicates that the temperature of the heat roller 52 of the fixing device 50 is set to 100 degrees centigrade if the instruction of printing by the decolorable toner is issued. In the example in FIG. 3, 100 degrees centigrade is shown as the fixing temperature of the decolorable toner.

In a record registered in the third row of the temperature setting table, the printing instruction "printing by decolorable toner and the non-decolorable toner" is associated with the set temperature of "130 degrees centigrade". This indicates that the temperature of the heat roller 52 of the fixing device 50 is set to 130 degrees centigrade if an instruction of printing by the decolorable toner and the non-decolorable toner is issued. In the example in FIG. 3, 130 degrees centigrade is shown as the fixing temperature of the non-decolorable toner. 130 degrees centigrade is the fixing temperature of the non-decolorable toner, and is also the temperature at which the decolorable toner is decolored.

The set temperatures shown in the temperature setting table above are examples.

Figure 4:
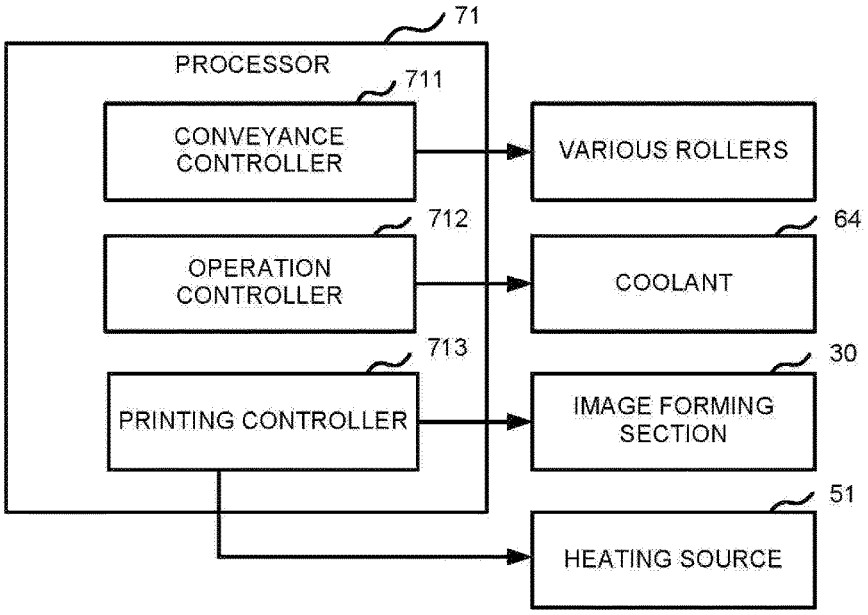
FIG. 4 is a schematic block diagram illustrating an example of functional components of a processor.

FIG. 4 is a schematic block diagram indicating an example of the functional components of the processor 71. The processor 71 includes a conveyance controller 711, an operation controller 712, and a printing controller 713.

The conveyance controller 711 controls conveyance of the sheet 41 by controlling various rollers of the conveyance section 80. For example, if the printing instruction is made, the conveyance controller 711 controls the pickup roller to pick up the sheet 41 one by one from the sheet housing section 40.

The operation controller 712 controls the operation of the cooling section 60. For example, the operation controller 712 controls the coolant 64 to lower the temperature in the cooling section 60 to a prescribed value (e.g., −20 degrees centigrade) if the power of the image forming apparatus 1 is supplied to the cooling section 60. For example, in the operation of the image forming apparatus 1, the operation controller 712 periodically controls the coolant 64 to maintain the temperature in the cooling section 60 at the prescribed value.

The printing controller 713 executes the image forming processing in response to the printing execution instruction. For example, the printing controller 713 selects the toner to be used in the image forming section 30 and the temperature of the fixing device 50 by referring to the temperature setting table in response to the content of the printing execution instruction.

Figure 5:
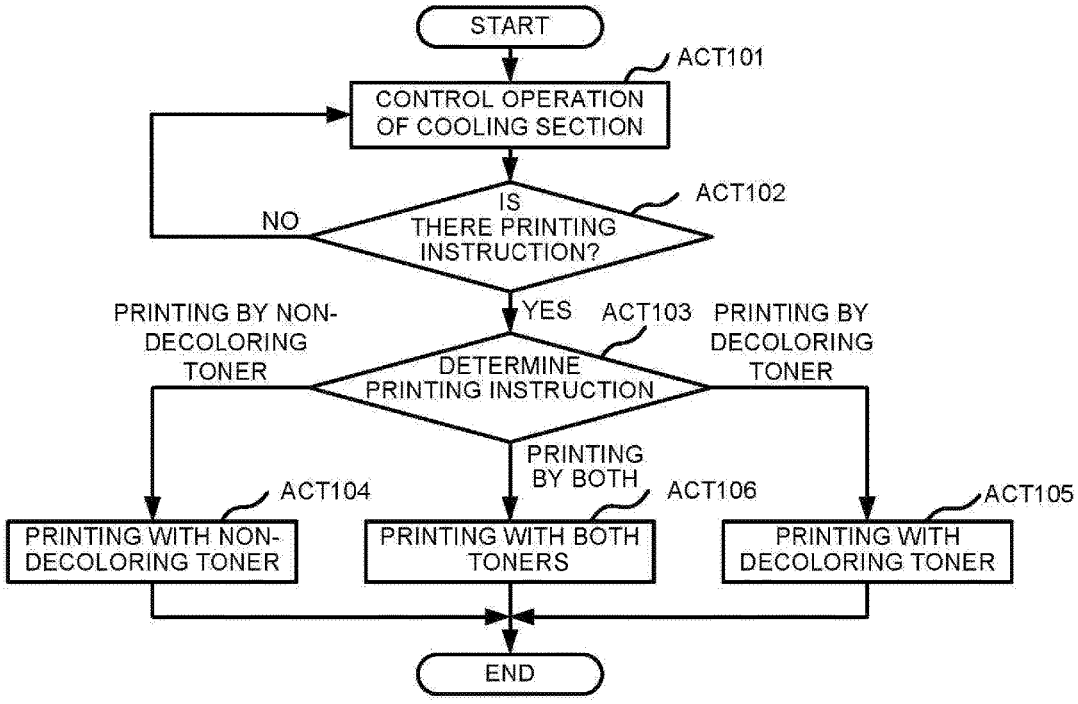
FIG. 5 is a flowchart depicting the flow of a processing by the image forming apparatus.

FIG. 5 is a flowchart depicting the flow of processing of the image forming apparatus 1.

The operation controller 712 controls the operation of the cooling section 60 (ACT 101). For example, if the power source of the image forming apparatus 1 is turned on, the operation controller 712 controls the coolant 64 to lower the temperature in the cooling section 60 to the prescribed value. Specifically, the operation controller 712 causes the cooling section 60 to lower the temperature in the cooling section 60 to the prescribed value by applying the current needed to satisfy the prescribed value to the coolant 64. In the operation of the image forming apparatus 1, the operation controller 712 periodically controls the coolant 64 to maintain the temperature in the cooling section 60 at the prescribed value.

The printing controller 713 determines whether or not there is a printing instruction (ACT 102). If there is no printing instruction (No in ACT 102), the printing controller 713 waits for until the printing instruction is issued.

On the other hand, if there is the printing instruction (Yes in ACT 102), the printing controller 713 determines the content of the printing instruction (ACT 103). In a case in which the content of the printing instruction is the non-decolorable toner printing (ACT 103: printing by the non-decolorable toner), the printing controller 713 performs printing with the non-decolorable toner (ACT 104). Specifically, the printing controller 713 first enables the conveyance controller 711 to convey the sheet 41.

The conveyance controller 711 controls the rollers to convey the sheet 41 under the control of the printing controller 713. The conveyance section 80 conveys the sheet 41. Next, the printing controller 713 controls the image forming section 30 to execute the image formation by the non-decolorable toner. The printing controller 713 refers to the temperature setting table to acquire information on the fixing temperature of the non-decolorable toner. In the example in FIG. 3, the printing controller 713 acquires the information of 130 degrees centigrade as the information on the fixing temperature of the non-decolorable toner.

The printing controller 713 performs the control so that the temperature of the heat roller 52 becomes the acquired fixing temperature (130 degrees centigrade) by energizing the heating source 51 of the fixing device 50. Under the control of the printing controller 713, the image forming section 30 executes the image formation by the non-decolorable toner on the conveyed sheet 41. The conveyance controller 711 controls the rollers to convey the sheet 41 on which the image is formed to the fixing device 50. The conveyance section 80 conveys the sheet 41 to the fixing device 50.

The fixing device 50 fixes the toner by heating the conveyed sheet 41. As a result, the printing by the non-decolorable toner is executed. Thereafter, the conveyance controller 711 controls the rollers to discharge the heated sheet 41 to the discharge section 90 via the cooling section 60. The sheet 41 subjected to the image formation by the non-decolorable toner does not change even if cooled by the cooling section 60.

If the content of the printing instruction is the printing by the decolorable toner (ACT 103: printing by the decolorable toner), the printing controller 713 performs printing with the decolorable toner (ACT 105). Specifically, the printing controller 713 first enables the conveyance controller 711 to convey the sheet 41.

The conveyance controller 711 controls the rollers to convey the sheet 41. The conveyance section 80 conveys the sheet 41. Next, the printing controller 713 controls the image forming section 30 to execute the image formation by the decolorable toner. The printing controller 713 refers to the temperature setting table to acquire information on the fixing temperature of the decolorable toner. In the example in FIG. 3, the printing controller 713 acquires the information of 100 degrees centigrade as the information on the fixing temperature of the decolorable toner.

The printing controller 713 performs control so that the temperature of the heat roller 52 becomes the acquired fixing temperature (100 degrees centigrade) by energizing the heating source 51 of the fixing device 50. Under the control of the printing controller 713, the image forming section 30 executes the image formation by the decolorable toner on the conveyed sheet 41. The conveyance controller 711 controls the rollers to convey the sheet 41 on which the image is formed to the fixing device 50. The conveyance section 80 conveys the sheet 41 to the fixing device 50.

The fixing device 50 fixes the toner by heating the conveyed sheet 41. As a result, the printing by the decolorable toner is executed. Thereafter, the conveyance controller 711 controls the rollers to discharge the heated sheet 41 to the discharge section 90 via the cooling section 60. The sheet 41 subjected to the image formation by the decolorable toner does not change even if it is cooled by the cooling section 60 because the image is not decolored.

If the content of the printing instruction is printing by both (ACT 103: printing by both), the printing controller 713 performs printing with both toners (ACT 106). For example, the printing controller 713 performs the printing using both the decolorable toner and the non-decolorable toner. In this case, it is assumed that an area to be printed by the decolorable toner and an area to be printed by the non-decolorable toner are set in the print data. The setting of each print area may be set in advance by the user or may be dynamically set by the printing controller 713. In a case in which the user sets the print area in advance, for example, it can be set using a known technology (for example, U.S. Pat. No. 9,348,546).

If the printing controller 713 dynamically sets the print area, the printing controller 713 sets a predetermined text string and image in a text of the print data as the area printed with the decolorable toner. In this case, the printing controller 713 sets text strings and images other than the predetermined text string and image as an area printed with the non-decolorable toner. Or, the printing controller 713 sets a predetermined text string and image among the text of the print data as the area printed with the non-decolorable toner. In this case, the printing controller 713 sets the text strings and images other than the predetermined text string and image as the area printed with the decolorable toner.

Thereafter, the printing controller 713 enables the conveyance controller 711 to convey the sheet 41. The conveyance controller 711 controls the rollers to convey the sheet 41. The conveyance section 80 conveys the sheet 41. Next, the printing controller 713 controls the image forming section 30 to execute the image formation by the decolorable toner and the non-decolorable toner. The printing controller 713 transmits information on the area printed with the decolorable toner and information on the area printed with the non-decolorable toner to the image forming section 30.

In addition, the printing controller 713 refers to the temperature setting table to acquire the information on the fixing temperatures of the decolorable toner and the non-decolorable toner. In the example in FIG. 3, the printing controller 713 acquires the information of 130 degrees centigrade as the information on the fixing temperatures of the decolorable toner and the non-decolorable toner.

The printing controller 713 performs control so that the temperature of the heat roller 52 becomes the acquired fixing temperature (130 degrees centigrade) by energizing the heating source 51 of the fixing device 50. Under the control of the printing controller 713, the image forming section 30 executes the image formation by the decolorable toner and the non-decolorable toner on the conveyed sheet 41. The conveyance controller 711 controls the rollers to convey the sheet 41 on which the image is formed to the fixing device 50. The conveyance section 80 conveys the sheet 41 to the fixing device 50.

The fixing device 50 fixes the toner by heating the conveyed sheet 41. As a result, the printing by the decolorable toner and the non-decolorable toner is executed. The temperature of the heating roller 52 of the fixing device 50 is the fixing temperature of the non-decolorable toner and is the decoloring temperature of the decolorable toner. Therefore, the image formed by the decolorable toner is decolored on the sheet 41 subjected to the image formation. Thereafter, the conveyance controller 711 controls the rollers to discharge the heated sheet 41 to the discharge section 90 via the cooling section 60. On the sheet 41 subjected to the image formation by the decolorable toner and the non-decolorable toner, the image formed by the decolorable toner has been decolored. The temperature in the cooling section 60 is a temperature at which the color of the image formed by the decolorable toner is recovered. Therefore, the color of the image formed by the decolorable toner decolored in the fixing device 50 is recovered.

According to the image forming apparatus 1 constituted as described above, the sheet on which an image is formed by the decolorable toner and the non-decolorable toner is cooled after heating. Here, the cooling of the sheet is carried out, for example, by conveying the sheet 41 to the cooling section 60 or stopping the sheet 41 at the cooling section 60 for a predetermined time. Here, preferably, a conveyance speed of the sheet 41 at the time of being conveyed to the cooling section 60 is lower than a conveyance speed before conveyance to the cooling section 60. Therefore, the image formed by the decolorable toner which is already decolored at the fixing temperature of the non-decolorable toner is restored. In this way, the image forming apparatus 1 can perform the printing using the decolorable toner and the non-decolorable toner in one printing. Therefore, it is possible to shorten the time required for printing using both the decolorable toner and the non-decolorable toner.

Below, modifications of the image forming apparatus 1 are described.

In the present embodiment, the image forming section 30 forms an image using both the decolorable toner and the non-decolorable toner. The image forming section 30 may form an image using a color material other than the toner. For example, the image forming section 30 may form an image using ink as the color material. In such a case, the image forming section 30 forms an image using decolorable ink decolorable by heating and non-decolorable ink which is not decolored by heating.

The heating source 51 may be composed of a plurality of heater lamps. The heating source 51 may be composed of a plurality of induction heating (IH) type heaters. The heating source 51 may be composed of a combination of the heater lamp and the heater.

The temperature setting table may be stored in the ROM 72 or may be transmitted from another device via the network interface 130 and copied or developed in the RAM 73.

In the present embodiment, a case in which the conveyance speed of the sheet 41 is constant from the time at which the printing instruction is issued until the sheet 41 is discharged is described as an example, but the present invention is not limited thereto. For example, the conveyance speed of the sheet 41 from the issuance of the printing instruction to the execution of the fixing may be controlled to be different from the conveyance speed of the sheet 41 from the fixing to the discharge of the sheet 41. The conveyance speed of the sheet 41 from the issuance of the printing instruction to the execution of the fixing is set as a first conveyance speed. The conveyance speed of the sheet 41 from just after a completion of the fixing to the discharge of the sheet 41 is set as a second conveyance speed.

The conveyance controller 711 controls the second conveyance speed to be lower than the first conveyance speed. Whether the fixing is already completed may be determined based on whether a predetermined time elapses after the printing instruction. If the predetermined time elapses since the printing instruction, the conveyance controller 711 determines that the fixing is already completed. In this case, the conveyance controller 711 controls the conveyance speed of the sheet 41 to be a conveyance speed lower than the first conveyance speed. If the predetermined time has not elapsed since the reception of the printing instruction, the conveyance controller 711 determines that the fixing is not completed yet. In this case, the conveyance controller 711 controls the conveyance speed of the sheet 41 to be the first conveyance speed.

With such control, it is possible to lengthen the time to cool the sheet 41. Therefore, it is possible to increase the probability for restoring the decolored image.

The conveyance controller 711 may control the conveyance speed of the sheet 41 according to a printing ratio of the data which is a printing object. The printing ratio of the data which is the printing object may be the percentage of the total area of the sheet that is printed. The printing ratio of the data which is the printing object may be the percentage of the total area of the sheet 41 that is printed using decolorable toner. The conveyance controller 711 controls the conveyance speed of the sheet 41 to be lower than a preset conveyance speed if the printing ratio of the data which is the printing object is equal to or higher than a threshold value. Specifically, the conveyance controller 711 lowers the conveyance speed of the sheet 41 to a speed lower than the preset conveyance speed by lowering rotational speed of the various rollers. There may be plural threshold values.

The operation controller 712 may control the temperature in the cooling section 60 according to the printing ratio of the data which is the printing object. The operation controller 712 controls the temperature in the cooling section 60 to be lower than a prescribed value if the printing ratio of the decolorable toner of the data which is the printing object is equal to or greater than a threshold value. In particular, the operation controller 712 causes the cooling section 60 to lower the temperature in the cooling section 60 to be lower than the prescribed value by applying more current to the coolant 64. There may be plural threshold values.

In the present embodiment, the cooling section 60 is always operated. However, if the printing by the non-decolorable toner and the printing by the decolorable toner are instructed, there is no need to cool the sheet 41. The reason is that it is not necessary to cool the sheet 41 for recoloring since the image on the sheet 41 is not decolored at the time of passing through the fixing device 50. Therefore, if the cooling section 60 is always operated, even if there is no need to cool the sheet 41, it is necessary to supply electric power to operate the cooling section 60. Therefore, the cost of electric power increases. Thus, the image forming apparatus 1 may operate the cooling section 60 only when the printing by the non-decolorable toner and the decolorable toner is instructed. The operation is described in detail with reference to FIG. 6.

Figure 6:
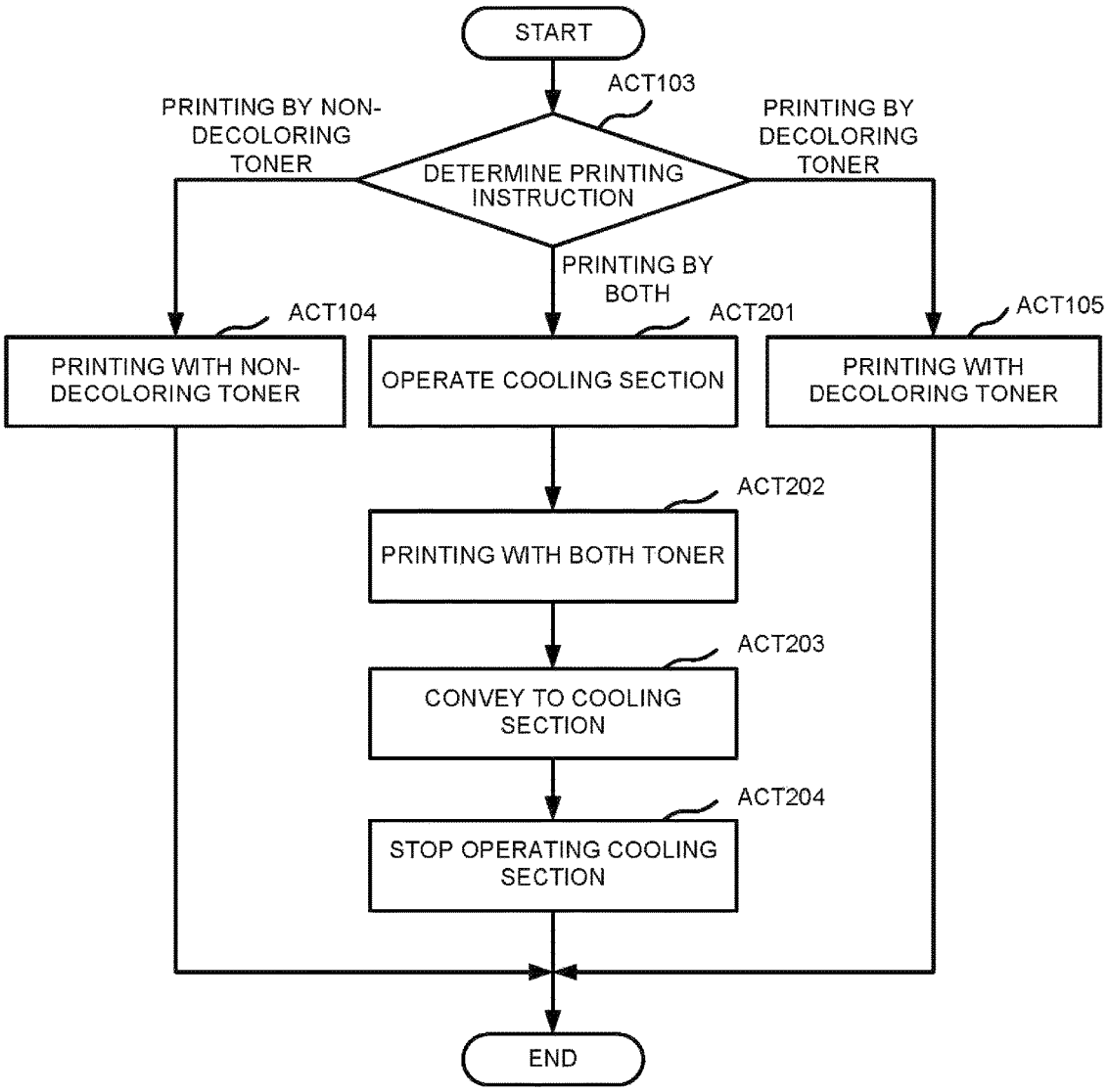
FIG. 6 is a flowchart depicting the flow of a processing in a modification of the image forming apparatus.

FIG. 6 is a flowchart depicting the flow of a processing in the modification of the image forming apparatus 1. The processing in FIG. 6 similar to that in FIG. 5 is donated with the same reference numerals as those in FIG. 5, and the description thereof is omitted.

If the content of the printing instruction is printing by the non-decolorable toner and the decolorable toner (ACT 103: printing by both), the printing controller 713 instructs the operation controller 712 to operate the cooling section 60. The operation controller 712 activates the cooling section 60 according to the instruction of the printing controller 713 (ACT 201). In particular, the operation controller 712 causes the cooling section 60 to lower the temperature in the cooling section 60 to the prescribed value by applying a current required to satisfy the prescribed value to the coolant 64. The printing controller 713 performs the printing by both toner (ACT 202). For example, the printing controller 713 performs the printing using both the decolorable toner and the non-decolorable toner. If the printing is completed, an image formed by the decolorable toner on the sheet 41 on which the image formation is performed by the decolorable toner and the non-decolorable toner is decolored. The conveyance controller 711 controls the rollers to convey the sheet 41 heated by the fixing device 50 to the cooling section 60 (ACT 203). The conveyance section 80 conveys the sheet 41.

On the sheet 41 on which the image formation is performed by the decolorable toner and the non-decolorable toner, the image formed by the decolorable toner is decolored. The cooling section 60 cools the conveyed sheet 41. As the sheet 41 is cooled, the color of the image formed by the decolorable toner which is decolored in the fixing device 50 is recovered. The sheet 41 passing through the cooling section 60 is discharged to the discharge section 90 by the rollers. The printing controller 713 enables the operation controller 712 to stop operation of the cooling section 60 after the sheet 41 passes through the cooling section 60.

The printing controller 713 determines that the sheet 41 already passes through the cooling section 60 as follows. For example, the printing controller 713 may determine that the sheet 41 passes through the cooling section 60 in response to elapse of a first time since the cooling section 60 is started. The first time is equal to or longer than a time from a moment the control device 70 receives the printing instruction until the sheet 41 is discharged to the discharge section 90. For example, the printing controller 713 may determine that the sheet 41 passes through the cooling section 60 at a timing at which a sensor provided inside the cooling section 60 or outside the cooling section 60 detects the sheet 41. If the sensor is provided in the cooling section 60, the sensor is provided at the downstream side of the coolant 64 in the conveyance direction in which the sheet is conveyed. If the sensor is provided outside the cooling section 60, the sensor is provided on the conveyance path between the cooling section 60 and the discharge section 90. The operation controller 712 stops the operation of the cooling section 60 according to the instruction of the printing controller 713 (ACT 204). Specifically, the operation controller 712 stops the operation of the cooling section 60 by stopping applying the current to the coolant 64.

With such control, it is possible to suppress power consumption. Therefore, the cost of electric power can be suppressed.

The cooling section 60 and the conveyance section 80 may be constituted as an image recoloring apparatus. In this way, the conveyance section 80 conveys the sheet 41 on which the image is formed by the decolorable color material and the non-decolorable color material. The cooling section 60 cools the heated sheet 41 conveyed by the conveyance section 80. The image recoloring apparatus may be provided with the sheet housing section 40. In this case, the sheet housing section 40 houses the sheet 41 on which the image is formed by the decolorable color material and the non-decolorable color material.

The cooling section 60 may cool the sheet 41 other than the Peltier element. For example, the cooling section 60 may cool the sheet 41 using a refrigerator, a freezer, or the like that uses a reverse Carnot cycle as a cooling method.

According to at least one embodiment described above, it is possible to shorten the time required for printing using the decolorable toner and the non-decolorable toner.

A part of the functions of the image forming apparatus 1 according to the embodiment described above may be realized by a computer. In that case, programs for realizing those functions are recorded on a computer-readable recording medium. Then, the functions may be realized by enabling a computer system to read and execute the programs recorded on the recording medium in which the above-described program is recorded.

The "computer system" here includes an operating system and hardware such as peripheral devices. The "computer-readable recording medium" refers to a portable medium or a storage device. The portable medium is a flexible disk, a magneto-optical disk, a ROM, a CD-ROM or the like. Furthermore, the storage device is a hard disk built in the computer system. Furthermore, the "computer-readable recording medium" dynamically holds programs for a short time like a communication line in the case of transmitting the programs via the communication wire. The communication line is a network such as an Internet, a telephone line, or the like. The "computer readable recording medium" may be a volatile memory in the computer system which is a server or a client. The volatile memory holds a program for a certain period. The above program may realize a part of the above-described functions. Furthermore, the above-described functions may be realized by a combination of the above-described program and a program already recorded in the computer system.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

a first image forming section configured to form an image on a sheet with a decolorable color material;

a second image forming section configured to form an image on the sheet with a non-decolorable color material;

a conveyance section configured to convey the sheet;

a conveyance controller configured to control a conveyance speed of the sheet conveyed by the conveyance section;

a fixing device configured to heat the sheet on which the images are formed with the decolorable color material and the non-decolorable color material; and a cooling section configured to cool the heated sheet, wherein the conveyance controller decreases the conveyance speed of the sheet after determining that the sheet has passed through the fixing device.

2. The image forming apparatus according to claim 1, further comprising:

an operation controller configured to control operation of the cooling section, wherein the operation controller operates the cooling section if an instruction to print on the sheet indicates use of both the decolorable color material and the non-decolorable color material, and does not operate the cooling section if the instruction does not indicate the use of both the decolorable color material and the non-decolorable color material.

3. The image forming apparatus according to claim 2, wherein the conveyance controller determines that the sheet has passed through the fixing device by measuring a time elapsed since the instruction to print is issued.

4. The image forming apparatus according to claim 1, wherein the conveyance controller is configured to determine a printing ratio of print data, and decrease the conveyance speed of the sheet after determining that the sheet has passed through the fixing device if the printing ratio of print data is equal to or greater than a threshold value.

5. The image forming apparatus according to claim 4, wherein the printing ratio is a percentage of a total area of the sheet that is printed.

6. The image forming apparatus according to claim 4, wherein the printing ratio is a percentage of a total area of the sheet that is printed using the decolorable color material.

7. The image forming apparatus according to claim 1, further comprising:

an operation controller configured to control operation of the cooling section, wherein the operation controller controls a temperature in the cooling section to be a temperature lower than a preset temperature if a printing ratio of print data is equal to or greater than the threshold value.

8. The image forming apparatus according to claim 1, wherein the cooling section is downstream of the fixing device in a conveyance direction of the sheet.

9. The image forming apparatus according to claim 1, wherein the decolorable color material is decolorable toner and the non-decolorable color material is non-decolorable toner.

10. An image forming apparatus, comprising:

a first image forming section configured to form an image on a sheet with a decolorable color material;

a second image forming section configured to form an image on the sheet with a non-decolorable color material;

a conveyance section configured to convey the sheet; and a conveyance controller configured to control a conveyance speed of the sheet conveyed by the conveyance section;

a fixing device configured to heat the sheet on which the images are formed with the decolorable color material and the non-decolorable color material;

a cooling section configured to cool the heated sheet, wherein the conveyance controller decreases the conveyance speed of the sheet after determining that the sheet has passed through the fixing device if a printing ratio of print data is equal to or greater than a threshold value.

11. The image forming apparatus according to claim 10, further comprising:

an operation controller configured to control operation of the cooling section, wherein the operation controller operates the cooling section if an instruction to print on the sheet indicates use of both the decolorable color material and the non-decolorable color material, and does not operate the cooling section if the instruction does not indicate the use of both the decolorable color material and the non-decolorable color material.

12. The image forming apparatus according to claim 11, wherein the conveyance controller determines that the sheet has passed through the fixing device by measuring a time elapsed since the instruction to print is issued.

13. The image forming apparatus according to claim 10, wherein the printing ratio is a percentage of a total area of the sheet that is printed.

14. The image forming apparatus according to claim 10, wherein the printing ratio is a percentage of a total area of the sheet that is printed using the decolorable color material.

15. The image forming apparatus according to claim 10, further comprising:

an operation controller configured to control operation of the cooling section, wherein the operation controller controls a temperature in the cooling section to be a temperature lower than a preset temperature if a printing ratio of print data is equal to or greater than the threshold value.

16. The image forming apparatus according to claim 10, wherein the cooling section is downstream of the fixing device in a conveyance direction of the sheet.

17. An image forming apparatus, comprising:

a first image forming section configured to form an image on a sheet with a decolorable color material;

a second image forming section configured to form an image on the sheet with a non-decolorable color material;

a fixing device configured to heat the sheet on which the images are formed with the decolorable color material and the non-decolorable color material;

a cooling section configured to cool the heated sheet; and an operation controller configured to control operation of the cooling section, wherein the operation controller controls a temperature in the cooling section to be a temperature lower than a preset temperature if a printing ratio of print data is equal to or greater than the threshold value.

18. The image forming apparatus according to claim 17, wherein the operation controller operates the cooling section if an instruction to print on the sheet indicates use of both the decolorable color material and the non-decolorable color material, and does not operate the cooling section if the instruction does not indicate the use of both the decolorable color material and the non-decolorable color material.

19. The image forming apparatus according to claim 17, wherein the cooling section is downstream of the fixing device in a conveyance direction of the sheet.

20. The image forming apparatus according to claim 17, wherein the decolorable color material is decolorable toner and the non-decolorable color material is non-decolorable toner.

* * * * *